US010837281B2

(12) United States Patent
Kathage

(10) Patent No.: US 10,837,281 B2
(45) Date of Patent: Nov. 17, 2020

(54) MINE SAFETY SYSTEM AND METHOD

(71) Applicant: Real Innovations Australia Pty Ltd, Springfield (AU)

(72) Inventor: Wade Kathage, Springfield (AU)

(73) Assignee: REAL INNOVATIONS AUSTRALIA PTY LTD, Springfield (AU)

( * ) Notice: Subject to any disclaimer, the term of this patent is extended or adjusted under 35 U.S.C. 154(b) by 0 days.

(21) Appl. No.: 16/093,538

(22) PCT Filed: Apr. 13, 2017

(86) PCT No.: PCT/AU2017/050324

§ 371 (c)(1),
(2) Date: Oct. 12, 2018

(87) PCT Pub. No.: WO2017/177271

PCT Pub. Date: Oct. 19, 2017

(65) Prior Publication Data

US 2019/0153864 A1 May 23, 2019

(30) Foreign Application Priority Data

Apr. 14, 2016 (AU) ..... 2016901386

(51) Int. Cl.

| | |
|---|---|
| ***E21F 5/10*** | (2006.01) |
| ***E21F 5/02*** | (2006.01) |
| ***A62C 3/02*** | (2006.01) |

(52) U.S. Cl.

CPC ..... *E21F 5/10* (2013.01); *E21F 5/02* (2013.01); *A62C 3/02* (2013.01)

(58) Field of Classification Search

CPC ..... E21F 5/02; E21F 5/08; E21F 5/10; A62C 3/02; A62C 3/0221

See application file for complete search history.

(56) References Cited

U.S. PATENT DOCUMENTS

| | | | | | |
|---|---|---|---|---|---|
| 1,578,628 | A | * | 3/1926 | Beatty | E21F 5/10 169/64 |
| 1,764,113 | A | * | 6/1930 | Miller | E21F 5/10 169/64 |
| 1,862,396 | A | | 6/1932 | Gray et al. | |
| 2,290,809 | A | * | 7/1942 | Morrow | E21F 5/10 406/60 |
| 2,489,090 | A | * | 11/1949 | Gurney | E21F 5/10 406/60 |

(Continued)

FOREIGN PATENT DOCUMENTS

| | | |
|---|---|---|
| GB | 2040657 | 9/1980 |

OTHER PUBLICATIONS

International Search Report and Written Opinion dated Jul. 11, 2017 for Application No. PCT/AU2017/050324.

*Primary Examiner* — Darren W Gorman

(74) *Attorney, Agent, or Firm* — Patterson + Sheridan, LLP

(57) ABSTRACT

A mine safety system is provided for preventing coal dust explosions in an underground coal mine. The system comprises a reservoir, for storing an inerting agent; a compressor, for providing compressed air; and a mixer, coupled to the reservoir and the compressor, for mixing the inerting agent and compressed air and providing the mixture to the underground coal mine. The reservoir is located outside of the coal mine.

20 Claims, 4 Drawing Sheets

(56) References Cited

U.S. PATENT DOCUMENTS

| | | | | | |
|---|---|---|---|---|---|
| 2,521,888 | A * | 9/1950 | Wilson | E21F 5/10 | 239/654 |
| 3,039,827 | A * | 6/1962 | Poundstone | E21F 5/10 | 406/109 |
| 3,333,896 | A * | 8/1967 | Diamanti | E21F 5/10 | 299/12 |
| 4,394,975 | A * | 7/1983 | Bare, Jr. | E21F 5/10 | 239/143 |
| 4,510,883 | A * | 4/1985 | Estes | E21F 5/10 | 118/305 |
| 4,538,941 | A * | 9/1985 | Thorne | B65G 53/42 | 406/143 |
| 4,673,131 | A * | 6/1987 | Travis | E21F 5/10 | 239/661 |
| 4,805,702 | A * | 2/1989 | White | A62C 3/02 | 169/45 |
| 4,872,598 | A * | 10/1989 | Travis | B05B 7/1418 | 222/630 |
| 6,135,368 | A * | 10/2000 | Protan | E21F 5/10 | 239/143 |
| 2004/0116064 | A1 | 6/2004 | Travis | | |
| 2012/0256020 | A1 | 10/2012 | Masloff et al. | | |
| 2013/0092764 | A1* | 4/2013 | Fornaci | E21F 5/10 | 239/654 |
| 2013/0266408 | A1 | 10/2013 | Zutaut | | |
| 2015/0115690 | A1 | 4/2015 | VanBuren | | |

* cited by examiner

MINE SAFETY SYSTEM AND METHOD

TECHNICAL FIELD

The present invention relates to mine safety. In particular, the invention relates to safety in underground coal mines.

BACKGROUND ART

Coal dust is a by-product of coal mining, which, when mixed with air, can form an explosive mixture. In particular, coal dust generally accumulates throughout a mine, including on a floor of underground roadways. One main risk is localised methane explosions is that the resulting pressure wave can lift the coal dust into the air, and can create an explosive mixture of coal dust particles suspended in the air, which may be ignited from the fire ball following the pressure wave from the methane explosion. This may in turn create further turbulence, lifting more dust, which may cause propagation of a much more powerful coal dust explosion throughout a mine.

Such coal dust explosions are generally devastating, and as such, several attempts have been made to prevent these explosions. In this regard, stone dusting is commonly used to prevent the ignition of coal dust. Stone dust is an inert dust, typically limestone dust, which is applied to the underground coal mine. In case of a methane explosion, as described earlier, both the stone dust and the coal dust are pushed into the air, and provided that adequate quantities of stone dust are present, the dust cloud is rendered inert and a coal dust explosion will not occur.

In longwall mining, it is generally accepted that a well dusted tail gate is essential to prevent coal dust explosions. However, it is not easy to adequately dust the tail gate of a longwall mine. Access into the tail gate may be difficult, for example due to poor road conditions, water levels or high levels of gas which prevent the use of machinery and labour in the mine.

Certain systems exist where dusting is provided across the longwall face using pod dusters. However, such systems are generally hard to maintain and not particularly effective. For example, coal dust drops out of the ventilation current at around 200 to 250 metres from the longwall face, while stone dust drops out at around 100 to 150 metres from the pod duster. As such, there is a zone of about 100 metres which is not adequately covered by the longwall face dusting system.

Other systems may thus be used to supplement these longwall face pod dusters, where bulk bags of stone dust, typically 1 tonne in size, are spiked and hung along the tail gate. Alternatively, pod dusters may be placed on the tailgate.

However, bulk bags are very ineffective, require significant underground resources, and are highly burdensome on underground equipment and workers causing very high logistical and intrastate costs. Similarly, pod dusters not able to regulate output effectively over long distances. As such, these systems are generally configured to provide large amounts of stone dust, that is not sufficiently suspended in the when it enters the mines air flow at the targeted location, which is costly, due to poor distance of flow and poor dust settlement on the underground roadways roof, floor and sides. Furthermore, plus such systems deliver the dust in such a way that the majority of dust is built up on the floor, which does not for fill its purpose and is at a quantity much higher than what is actually required than if done effectively.

These systems generally also require daily refilling of the pods and/or bags and are very costly to maintain. Where the system is supplied via bulk vertical silo arrangement, it is extremely difficult to relocate and thus very time consuming. Other systems cannot effectively be used as primary stone-dusting units, because of the time to refill, maintain and move. Furthermore, in many cases mining operations must be halted to perform dusting, which is very costly in terms of lost productivity.

As such, there is clearly a need for an improved mine safety system and operational methods for running a safe and economical underground coal mine It will be clearly understood that, if a prior art publication is referred to herein, this reference does not constitute an admission that the publication forms part of the common general knowledge in the art in Australia or in any other country.

SUMMARY OF INVENTION

The present invention is directed to mine safety systems and methods, which may at least partially overcome at least one of the abovementioned disadvantages or provide the consumer with a useful or commercial choice.

With the foregoing in view, the present invention in one form, resides broadly in a mine safety system, for preventing coal dust explosions in an underground coal mine, the system comprising:

a reservoir, for storing an inerting agent;

a compressor, for providing compressed air; and a mixer, coupled to the reservoir and the compressor, for mixing the inerting agent and compressed air and providing the mixture into the underground coal mine, wherein the reservoir is located outside of the coal mine.

Preferably, the inerting agent is stone dust. Suitably, the stone dust comprises limestone.

Preferably, the mixer is coupled to pipework that extends down a borehole of the mine.

Preferably, the underground coal mine comprises a longwall coal mine. Preferably, the mixer is coupled to an outlet in a return road way of a coal mine, such as a tail gate of a longwall process or along conveyor roadways on homotropal ventilation Preferably, the mixer is further coupled to a manual hose, for manually spraying stone dust in the mine.

Preferably, the reservoir and mixer are on a trailer. Preferably, the compressor is also on the trailer. The trailer may be a B-Double trailer.

Preferably, the system includes a generator, for powering the compressor and mixer. Preferably, the generator is also on the trailer Preferably, the reservoir comprises a horizontal silo. Suitably, the silo is adapted to be filled by a bulk tanker when the system is in use.

Preferably, the reservoir is at or about atmospheric pressure.

Preferably, the system includes an auger, for moving the stone dust from the reservoir to the mixer. Suitably, the auger enables moving of the stone dust to the mixer/delivery unit with out stopping the operation. The system is thus able to transfer the dust from an atmospheric pressure environment (the reservoir) to a pressurised environment (the mixer), without the need for stopping and at a variable rate to match the system present and future purposes.

The system may include a bulk storage container, in proximity to the reservoir, the bulk storage container for storing stone dust.

Preferably, the system includes a controller, for controlling a flow of stone dust into the mine.

The controller may control the flow of stone dust to the mixer. Suitably, the controller may control an operation rate of an auger, configured to move stone dust from the reservoir to the mixer. The auger may include a variable-speed drive (VSD) motor, the VSD motor controlled by the controller. Alternatively or additionally, the auger may include a servo motor.

The controller may comprise a programmable logic controller.

Alternatively or additionally, the controller may control the flow of air to the mixer. Suitably, the controller may control a pressure of the compressor.

The system may include one or more sensors, wherein the controller is configured to control the flow of stone dust into the mine at least in part according to the sensors.

The sensors may include an orifice plate for measuring an output flow of stone dust.

Preferably, the controller is configured to maintain a level of stone dust inside predefined thresholds.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way.

DESCRIPTION OF EMBODIMENTS

Figure 1:
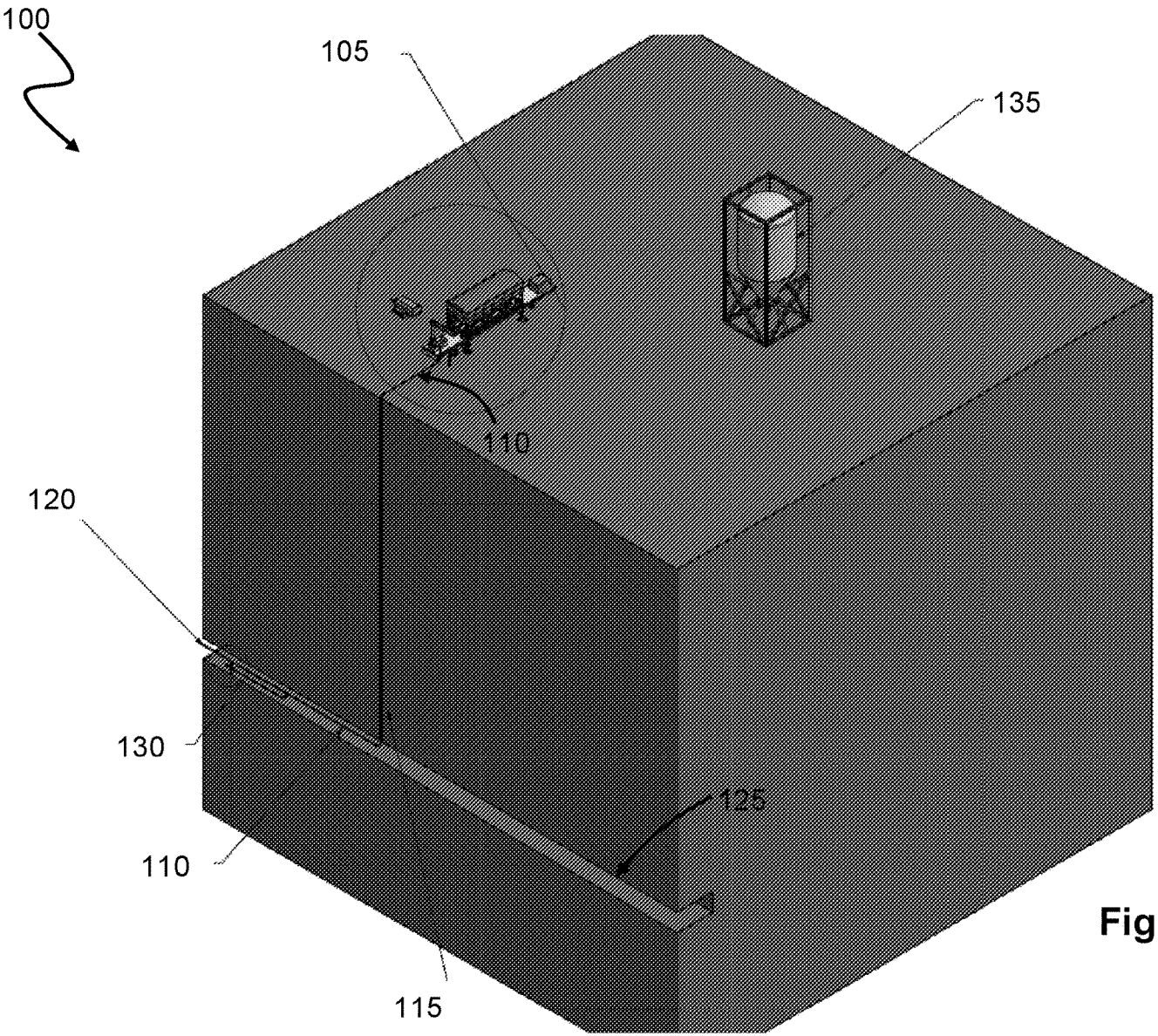
FIG. 1 illustrates a mine safety system, according to an embodiment of the present invention.

FIG. 1 illustrates a mine safety system 100, according to an embodiment of the present invention. The mine safety system 100 is configured to provide stone dust (limestone dust) to a tailgate of a longwall coal mine.

The system 100 enables the efficient application of stone dust to an underground coal mine, while reducing costly underground logistical activities, such as refilling of pods and bags of stone dust. Furthermore, as the system 100 is primarily above ground, it may be used where and when access is restricted due to high gas (methane) levels.

The system 100 also enables dusting to be performed simultaneously with mining operations, which decreases down time of the mine. As the system can more efficiently provide stone dust, the risk of coal dust explosion is also reduced.

The mine safety system 100 includes a dusting trailer 105, from which pipework 110 extends down a borehole 115 to an outlet 120 in a tailgate 125 of the mine. The trailer 105 is configured to provide stone dust mixed with air to the outlet 120, which is located inside the tailgate 125, to dust the tailgate to prevent coal dust explosions therein.

The trailer 105 is a B-Double trailer and is transported to the borehole 115 using a prime mover, and may be moved to a new bore hole when needed. In particular, no significant structure need be built at the borehole 115, making the system easily relocatable, and avoiding (or at least reducing) construction costs associated therewith.

As discussed in further detail below, a hose 130 is also provided for localised stone dusting. This is particular advantageous when a particular area of the tailgate 125 is not sufficiently dusted, as it enables that particular area to be "touched up" with stone dust, rather than increasing the stone dust levels in the entire tailgate.

Finally, a bulk storage silo 135 is located adjacent to the dusting trailer 105, and provides storage of stone dust for use by the trailer 105. The bulk storage silo may be any suitable size, but is advantageously about 60 tonne.

Figure 2:
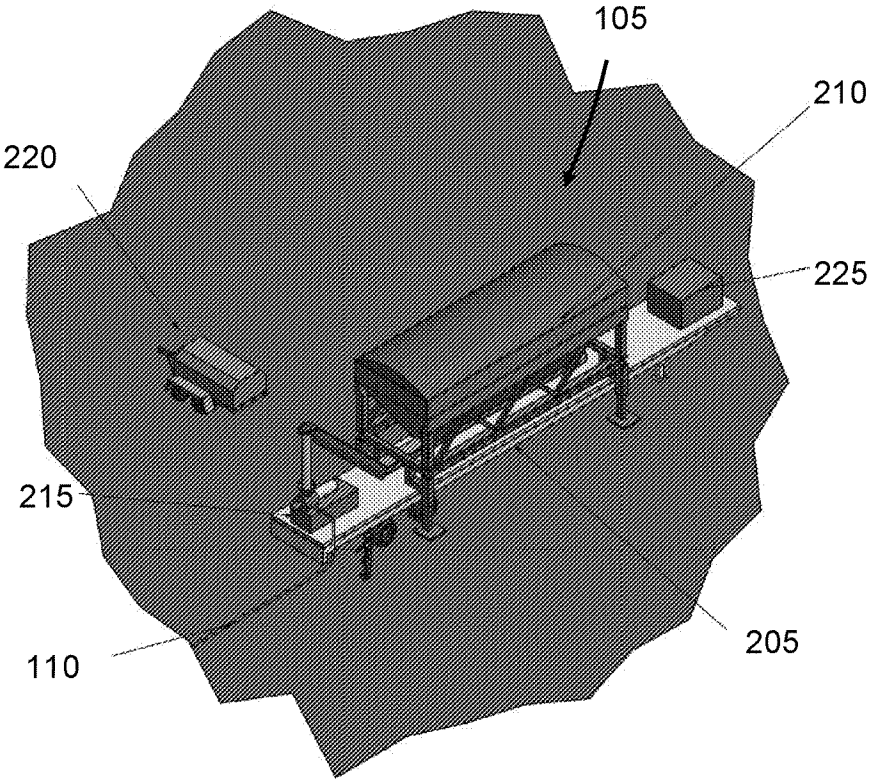
FIG. 2 illustrates the dusting trailer of the system of FIG. 1, according to an embodiment of the present invention.

FIG. 2 illustrates the dusting trailer 105 of FIG. 1, according to an embodiment of the present invention. In particular, the dusting trailer comprises a frame 205 having wheels, enabling the trailer 105 to be easily moved as required.

A bulk horizontal silo 210 is positioned centrally on the frame 205 and is for storing stone dust for application in the mine. The bulk horizontal silo 210 is particularly suited to being filled by a bulk tanker when the trailer 105 is in use. However, the skilled addressee will readily appreciate that the trailer may be filled, and transported to the bore hole 115 for use already filled.

The bulk horizontal silo 210 is coupled to a stone dust dispenser 215, which supplies a stone dust and air mixture to the tailgate 125 by the pipework 110. In particular, stone dust is supplied from the silo 210 to the stone dust dispenser 215, where it is mixed with compressed air from an air compressor 220, upon which the pressured mixture is dispensed using the pipework.

The stone dust thus goes from a normal pressure environment in the bulk horizontal silo 210, to a pressurised environment in the stone dust dispenser 215. This enables the bulk horizontal silo 210 to be refilled when being used (which is not possible with a pressurised storage environment), and enables the silo 210 to have the structure much like a typical silo.

The silo 210 includes an auger (not illustrated), which is configured to move the stone dust from the bulk horizontal silo 210 to the stone dust dispenser 215. The auger is powered by a variable-speed drive (VSD) motor, which enables control of the flow of stone dust, as discussed in further detail below.

Finally, a generator 225 is used to power the compressor 220, the stone dust dispenser 215, and the auger, this avoiding the need for an external power source. This further alleviates the need for external infrastructure at the borehole site.

The generator 225 and the compressor 220 may be of any suitable size. For example, the generator 225 may be a 100 kva generator, and the compressor 220 be an 1100 cubic feet per minute (CFM) compressor.

Figure 3:
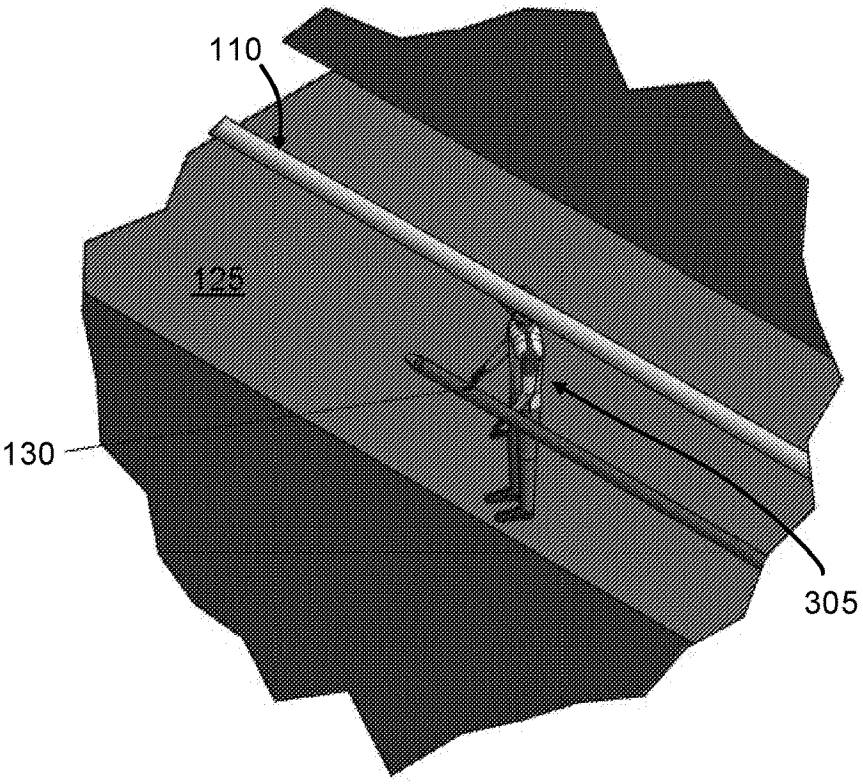
FIG. 3 illustrates the hose of the system of FIG. 1, according to an embodiment of the present invention.

FIG. 3 illustrates the hose 130 of FIG. 1, according to an embodiment of the present invention. The hose is coupled to the pipework at a suitable location, and is configured to be held and transported by a worker 305. The hose 130 is thus flexible, and includes a nozzle for efficient application of the stone dust by the worker 305.

The skilled addressee will readily appreciate that multiple hoses may be located at suitable locations along the tailgate 125. As such, the system 100 may be configured such that the entire tailgate 125 is accessible by at least one hose 130.

As discussed above, the stone dust dispenser 215 may have a variable feed rate. In such case, either or both of the air flow from the compressor 220 and the material flow from the silo 210 may be varied according to a desired flow rate.

Figure 5:
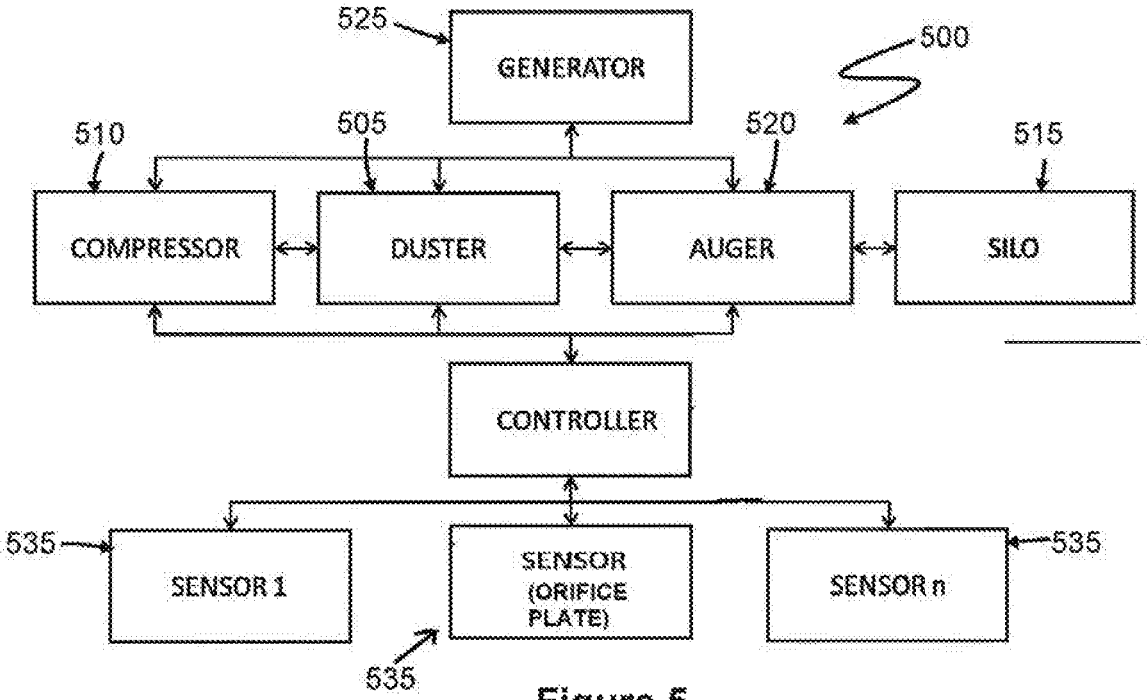
FIG. 5 illustrates a schematic of a mine safety system 500, according to an embodiment of the present invention.

In some embodiments, an output flow rate of the output 120 is metered by an orifice plate (see FIG. 5). The measured output flow rate may be compared to an output flow rate, and adjusted accordingly. This may include increasing or decreasing an operating rate of the auger, and/or increasing or decreasing an output pressure of the compressor 220.

According to certain embodiments, a plurality of sensors (see FIG. 5) are placed along the tailgate 125, to measure an amount of stone dust in different areas of the tailgate 125. If a level of stone dust is outside a predefined threshold, the rate of stone dust applied may be adjusted accordingly. For example, if high rates of stone dust are detected by the plurality of sensors, the rate of stone dust provided by the stone dust dispenser 215 may be automatically reduced.

The system 100 may be alternatively or additionally configured to issue alerts when an area is low in stone dust, or when a configuration of the system is outside its normal operation parameters. This may assist workers in identifying problems with the system 100, or with the sensors. As an illustrative example, the system 100 may be configured to automatically compensate for small deviations from an expected dusting scenario, but issue warnings when such deviations are above a particular threshold. The threshold may be set such that it relates to a problem in the system, rather than normal operating differences.

Figure 4:
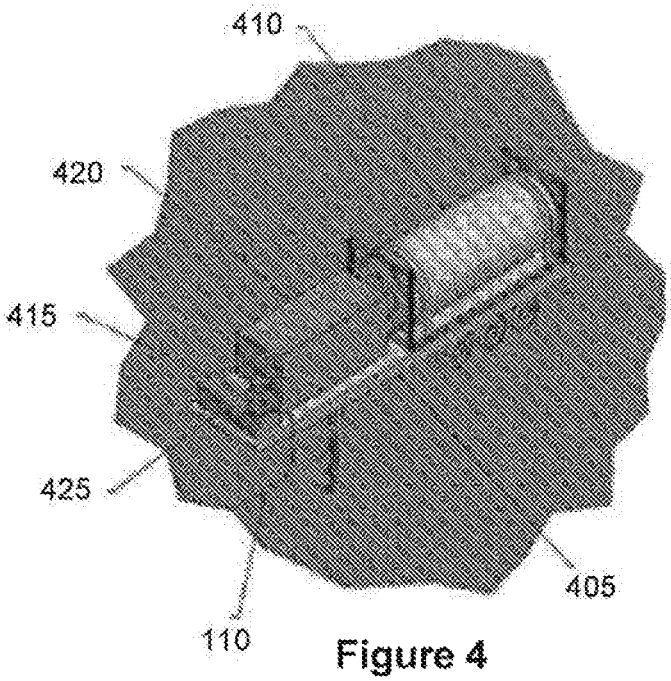
FIG. 4 illustrates a dusting trailer, according to an alternative embodiment of the present invention.

FIG. 4 illustrates a dusting trailer 400, according to an alternative embodiment of the present invention. The dusting trailer 400 is similar to the dusting trailer 105, but is entirely self-contained.

The trailer 400 includes a frame 405, a bulk horizontal silo 410, similar to the silo 210 but enclosed, a stone dust dispenser 415, similar to the stone dust dispenser 215 and coupled to the silo 410, a compressor 420, similar to the compressor 220 and coupled to the stone dispenser 415, and a generator (not illustrated), similar to the generator 225, for powering the compressor 420, the stone dust dispenser 415 and an auger of the silo 410.

A remote control and monitoring system 425 is provided under the stone dust dispenser 415, and is for monitoring and controlling the system. In particular, the remote control and monitoring system 425 monitors data of the mine and/or the system, and adjusts the flow of stone dust accordingly.

FIG. 5 illustrates a schematic of a mine safety system 500, according to an embodiment of the present invention. The system 500 may be similar to the system 100 of FIG. 1.

The system includes a duster 505, a compressor 510 coupled to the duster 505, and a silo 515 coupled to the duster 505 by an auger 520. The duster 505 is configured to provide stone dust to an underground coal mine to neutralise coal dust (i.e. make clouds of coal dust inert and prevent explosion), as described above.

A generator 525 is coupled to the compressor 510, the duster 505 and the auger 520, and powers these. Similarly, a controller 530 is coupled to the compressor 510, the duster 505 and the auger 520 and controls these. The controller 530 is coupled to a plurality of sensors 535, and controls the compressor 510, the duster 505 and the auger 520 based thereon.

The controller 530 may be coupled to a data network, such as a 3G mobile data network, to provide for remote monitoring and control of the system. As such, workers may only need to be on site in case of breakdown and maintenance, and not for routine operation.

Figure 6A:
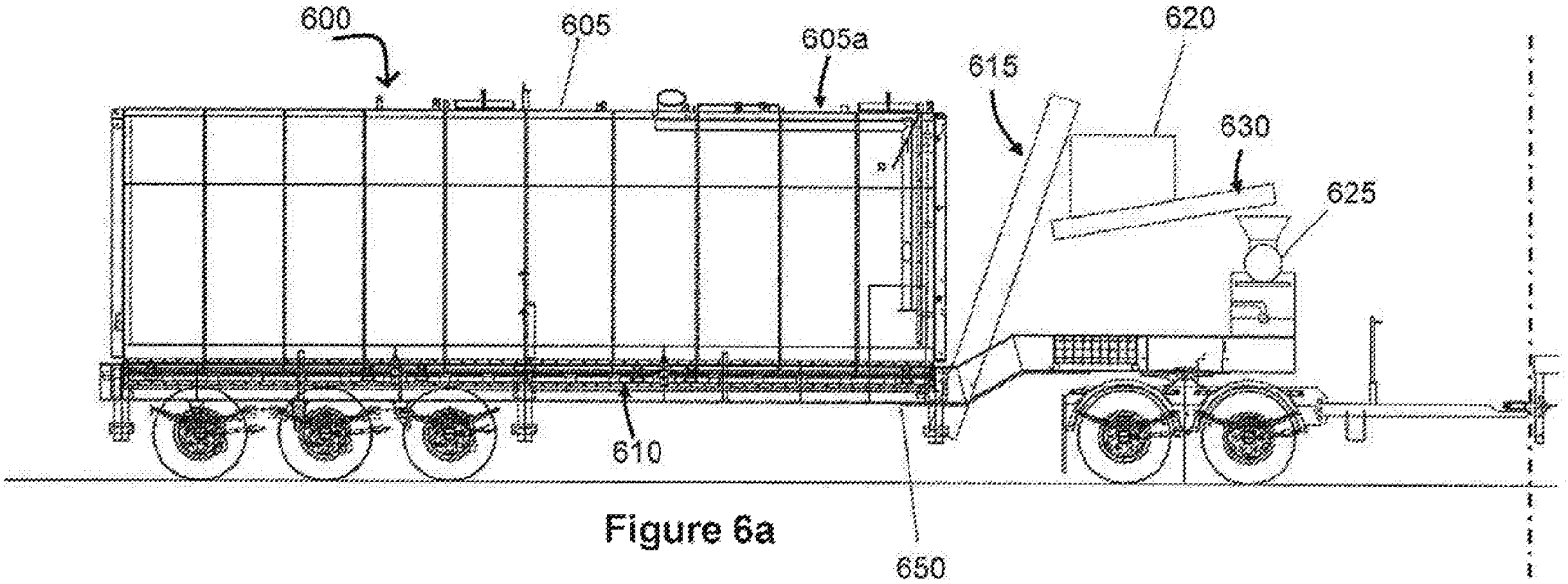
FIG. 6 illustrates a dusting trailer of a mine safety system, according to an embodiment of the present invention.
Figure 6B:
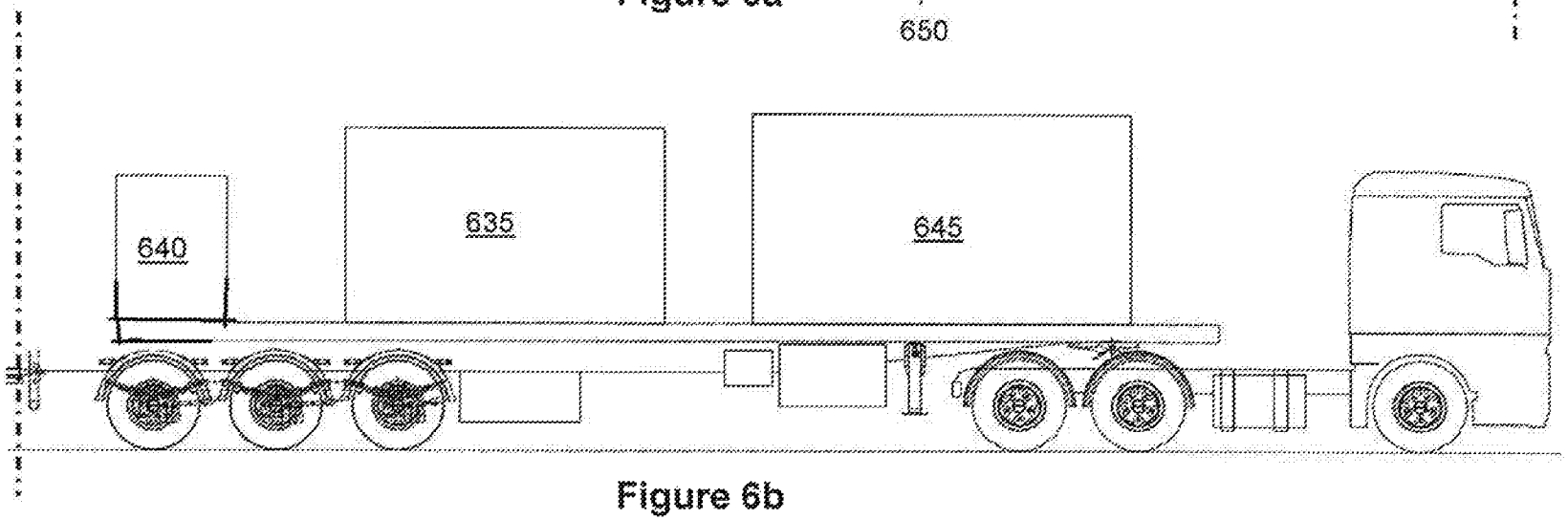

FIGS. 6*a* and 6*b* illustrates a mine dusting trailer 600, according to an alternative embodiment of the present invention. The mine dusting trailer 600 is configured to be used with a mine safety system, like the mine safety system 100. In particular, pipework (not illustrated) extends from the dusting trailer 600 down a borehole to an outlet in a tailgate of a mine, and is configured to provide stone dust mixed with air to the outlet to dust the tailgate to prevent coal dust explosions therein.

The mine dusting trailer 600 includes a silo 605, for receiving stone dust (limestone dust). The silo 605 has a 75 T nominal capacity based upon a density of 1400 kg/m3 stone dust and a silo volume of 53 m2.

The silo 605 is fitted with a roof mounted dust filter (not illustrated), which incorporates a safety vent valve. Air displaced during filling or during an over pressure incident is ducted to within 1 m of the ground in spiral ducting.

The silo 605 includes load cells (not illustrated), which are used to measure a weight of stone dust in the silo 605. This is particularly useful for stocktaking purposes.

The filling procedure is generally performed at a filling station, where a tanker outlet hose is hooked into a fill point of the silo 605. The silo is then filled by pumping the stone dust through the fill point.

The silo 605 includes a level sensor (not illustrated) on a roof of the silo, and when stone dust reaches the level sensor a fill controller sounds a warning. This enables filling personnel to shut down fill process and thus prevent overfilling. If the fill process isn't shut down, the controller may close a fill valve of the silo 605 automatically.

The silo 605 also has a bulk bag unloading opening 605*a* on the roof, to enables bulk bag based filling.

After the silo 605 is filled, reverse pulsing of air is provided to clean the filter. In such case a timer may be used to automatically cause the filter to be reverse pulsed for a predetermined amount of time.

A controller (not illustrated) is used to control discharge of stone dust from the silo and into the mine, as described below.

A horizontal screw 610 is located at a lower portion of the silo 605 and is configured to drive stone dust to an incline screw 615 at an end of the silo 605. The incline screw 615 is configured to provide stone dust to a hopper 620, which is in turn provided to a stone dust feeder 625 by a screw 630.

The stone dust feeder 625 receives the stone dust, and mixes the stone dust with compressed air from a compressor 635 using an airlock, and provides the mixture into the pipework and thus into the tailgate of the mine.

The horizontal screw 610 and the incline screw 615 are configured to feed the hopper 620 until it reaches a desired weight. In particular, load cells (not illustrated) are provided in the hopper and are coupled to the controller to enable weight data to be provided thereto.

The rate of discharge of stone dust is controlled by the controller by adjusting a speed of the screw. In particular, the controller may use a change in weight of the hopper 620 to determine a rate, and adjust the speed of the screw based thereon.

The compressor 635 supplies the compressed air through a dryer 640. The dryer removes moisture from the air, and thus reduces blocking caused by moisture.

Finally, a generator 645 is used to power the compressor and other components.

The inclined screw 615 is started immediately prior to the horizontal screw 610, to minimise the risk of compacting stone dust between the horizontal screw 610 and the incline screw 615.

The silo 605 may also be discharged into an existing site tank using a diverter valve (not illustrated). In such case, a control panel 650, which is coupled to the controller, is provided to enable manual operation of the screws.

According to certain embodiments, the pressure in the system is monitored, and alarms are triggered if outside of the limits. Pulses of air may be automatically provided to clear blockages in pipes.

Similarly, the controller may be configured to trigger alarms if the weight of the hopper 620 is outside of predefined limits, or if other sensor data is outside operational boundaries. This enables workers to identify issues with the system and take corrective action.

According to certain embodiments (not illustrated) a pressure boost compressor may be provided to allow for greater means of unblocking lines and/or to increase capacity for multiple outlet systems.

The controller may also be configured to detect risks associated with the system, such as sensing build up in a pipeline. In such case, the system may automatically operate control measures to reduce the risk.

As an illustrative example, the controller may be configured to monitor the buildup of material on a bottom of the pipeline, which may indicate that laminar flow is causing stone-dust particles to gravitate to the bottom of the pipe line. As a result, the controller may be configured to break up the laminar flow and remix the stone-dust into a move even distribution in the air flow. This may be achieved using vortex generators, developed to break laminar flow of the conveyance flow within the pipeline and also at the outlet of the pipe line.

The systems described above may be adapted to include redundancy, and in such case, function when part of the system breaks down. This may be achieved through automatic diversion, or the ability to switch to the backup systems, for example.

According to certain embodiments, the pipeline may utilise wear resistant pipeline inserts, which are formed of ceramic and polymer material, and are fire and static resistant. At high impact areas of material flow, interchangeable wear plates may be provided.

According to certain embodiments, a compressed air centrifuge type water extraction system may be provided in an underground air reticulation system. Thus the stone dust need not be provided in a bore hole, but instead may be pushed into the mine through other entry points, such as roadways. This is particularly useful where the mine does not have the access rights on the surface.

In such case, the system may be configured to extract 90% plus moisture out of the underground compressed air prior to being coupled to in line air boosters, and thus increase the pressure based on the corona theory. Such system may be combined with vortex generators and inline double oscillating cyclone systems to ensure non laminar flow.

According to certain embodiments, the effectiveness of the distribution of the coal dust in the mine, including the distance of travel before drop out, is automatically monitored. In particular, high speed photographic and laser devices are provided that capture images or data of the flow of stone dust into the mine, and be analysed to determined the effectiveness of the distribution. In such case, the system may be automatically or manually adjusted to improve the system performance.

While the above has been described with reference to stone dust, the skilled addressee will readily appreciate that different material may be used. In particular, the systems described above may be adapted to collect and apply other materials, such as materials used for roadworks, grouting work, shotcreting and fibrecrete.

Advantageously, the systems may be used to apply stone dust to the mining area from a bulk system on the surface, removing the need for much of the underground equipment associated costs with traditional methods, and costs associated therewith.

As a result, major costly underground logistical activities are reduced, which also improves the environmental conditions underground, e.g. through reduced use of diesel equipment.

The systems described above can be used while mining operations continue, and in parallel thereto. Furthermore, dispersion and inertisation of the mining area is improved, which reduces the risk of explosion.

The use of a controller allows for the application of stone dust to match mining rates. For example, as mining rates go up or down, stone dusting rates may go up and down to match.

As the stone dust is stored in a non pressurised environment, the stone dust may be refilled without halting the dusting.

As application of stone dust is significantly improved, costs associated with over-dusting are avoided or reduced.

Furthermore, the system allows for stone dusting to be performed even when access is restricted to machinery and workers due to high levels of methane gases.

Combinations of the above aid in reducing operational costs and maintenance costs, and enable the system to me easily relocated to new mining areas.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A mine safety system, for preventing coal dust explosions in an underground coal mine, the system comprising:
   a reservoir, for storing an inerting agent comprising stone dust;
   a compressor, for providing compressed air;
   a mixer, coupled to the reservoir and the compressor, for mixing the inerting agent and compressed air and providing the mixture to the underground coal mine; wherein the reservoir is located outside of the coal mine;
   a controller for controlling a flow of stone dust into the mine; and
   one or more sensors, wherein the controller is configured to control the flow of stone dust into the mine at least in part according to the one or more sensors.

2. The system of claim 1, wherein the mixer is coupled to pipework that extends down a borehole of the mine.

3. The system of claim 1, wherein the underground coal mine comprises a longwall coal mine.

4. The system of claim 3, wherein the mixer is coupled to a tail gate of a longwall mine.

5. The system of claim 4, wherein a plurality of sensors are placed along the tailgate to measure an amount of stone dust in different areas of the tailgate such that the rate of stone dust applied may be adjusted accordingly.

6. The system of claim 5, wherein the system is configured to issue alerts when an area is low in stone dust or when a configuration of the system is outside its normal operating parameters.

7. The system of claim 1, wherein the mixer is coupled to a manual hose, for manually spraying the inerting agent in the mine.

8. The system of claim 1, wherein the reservoir and mixer are on a trailer.

9. The system of claim 1, wherein the system includes a generator, for powering the compressor and mixer.

10. The system of claim 1, wherein the reservoir comprises a horizontal silo.

11. The system of claim 10, wherein the silo is adapted to be filled by a bulk tanker when the system is in use.

12. The system of claim 1, wherein the reservoir is at or about atmospheric pressure.

13. The system of claim 1, further including a bulk storage container, in proximity to the reservoir.

14. The system of claim 1, wherein the controller is configured to control an operation rate of an auger that is configured to move stone dust from the reservoir to the mixer.

15. The system of claim 14, wherein the auger is configured to transfer the stone dust from an atmospheric pressure environment in the reservoir to a pressurized environment in the mixer.

16. The system of claim 1, wherein the controller is configured to control a flow of air to the mixer.

17. The system of claim 1, wherein the one or more sensors include an orifice plate for measuring an output flow of stone dust.

18. The system of claim 1, wherein the controller is configured to maintain a level of stone dust inside predefined thresholds.

19. The system of claim 1, wherein the controller is coupled to a data network to provide for remote monitoring and control of the system.

20. The system of claim 1, further comprising a dryer and the compressor supplies the compressed air through the dryer.

* * * * *